US010794115B2

(12) United States Patent
Cheng

(10) Patent No.: US 10,794,115 B2
(45) Date of Patent: Oct. 6, 2020

(54) SAFE CURTAIN CONTROL ASSEMBLY WITHOUT SCREW

(71) Applicant: CHEN TIAN CO, LTD., Tainan (TW)

(72) Inventor: Ching-Hsiang Cheng, Tainan (TW)

(73) Assignee: Chen Tian Co., Ltd., Tainan (TW)

( * ) Notice: Subject to any disclaimer, the term of this patent is extended or adjusted under 35 U.S.C. 154(b) by 343 days.

(21) Appl. No.: 15/887,009

(22) Filed: Feb. 2, 2018

(65) Prior Publication Data

US 2019/0128059 A1 May 2, 2019

(30) Foreign Application Priority Data

Nov. 2, 2017 (TW) ..... 106137996 A

(51) Int. Cl.
*E06B 9/322* (2006.01)
*E06B 9/78* (2006.01)
*E06B 9/326* (2006.01)

(52) U.S. Cl.
CPC ..... *E06B 9/322* (2013.01); *E06B 9/78* (2013.01); *E06B 2009/3265* (2013.01); *E06B 2009/785* (2013.01)

(58) Field of Classification Search
CPC .... E06B 9/322; E06B 2009/3265; E06B 9/78; E06B 2009/785
See application file for complete search history.

(56) References Cited

U.S. PATENT DOCUMENTS 8,336,598 B1 * 12/2012 Chang ..... E06B 9/56 160/177 V
9,151,109 B2 * 10/2015 Kawai ..... E06B 9/262
9,357,868 B2 * 6/2016 Anderson ..... E06B 9/322
2016/0090778 A1 * 3/2016 DeWard ..... E06B 9/322 160/321
2019/0211622 A1 * 7/2019 Kao ..... E06B 9/322

FOREIGN PATENT DOCUMENTS

TW M482633 U 7/2014
TW M542424 U 6/2017

OTHER PUBLICATIONS

Zheng, M542424; Machine translation, retrieved from https://worldwide.espacenet.com/publicationDetails/biblio?CC=TW&NR= M542424U&KC=U&FT=D&ND=3&date=20170601&DB=&locale=en_EP (Year: 2017).*

* cited by examiner

*Primary Examiner* — Katherine W Mitchell
*Assistant Examiner* — Abe Massad
(74) *Attorney, Agent, or Firm* — Rosenberg, Klein & Lee

(57) ABSTRACT

A safe curtain control assembly which does not require screws to assemble is revealed. The safe curtain control assembly includes a stopping portion located on a wall of a cavity of a base forming a raised structure, and a recessed area is formed by the wall of the cavity and the stopping portion. A sleeve, an elastic member and a drive member are mounted within the cavity of the base in turn. A second stopping flange of the drive member is positioned in the recessed area between the wall of the cavity and the stopping portion for preventing the sleeve, the elastic member, and the drive member assembled from being released. Thereby the base, the sleeve, the elastic member and the drive member are secured firmly without screws so as to save time and cost for each assembly.

7 Claims, 8 Drawing Sheets

SAFE CURTAIN CONTROL ASSEMBLY WITHOUT SCREW

BACKGROUND OF THE INVENTION

Field of the Invention

The present invention relates to a curtain control assembly without screws, especially to a safe curtain control assembly that features a simple structure, easy assembling and no screws required during assembling.

Description of Related Art

Refer to Taiwanese Pat. Pub. No. M482633U, a curtain control assembly with a bead chain that is easily assembled is described. A bead chain base is passed through and fixed on a main body of the curtain control assembly by fasteners. The production cost of the design is increased by the fasteners, and the assembly process is time-consuming. Moreover, children may be unable to pull and release the bead chain base fastened on the main body when they get strangled by the bead chain around their neck. In order to prevent the above condition, refer to Taiwanese Pat. Pub. No. M542424U, in which a curtain control assembly is described. The curtain control assembly can prevent children from being strangled by the bead chain or cord. However, the structure of the curtain control assembly is complicated so that the production cost is high and the assembling process is time-consuming. The design doesn't meet the requirement of modern industry for high productivity at low cost.

SUMMARY OF THE INVENTION

Therefore it is a primary object of the present invention to provide a safe curtain control assembly that features a simple structure, easy assembly and no screws involved during assembling.

In order to achieve the above object, a safe curtain control assembly without screws according to the present invention mainly includes a base, a sleeve, an elastic member and a drive member. The base consists of a cavity formed on a center of one surface thereof and at least one stopping portion located on a wall of the cavity. A raised-and-recessed structure is formed by the stopping portion and the wall of the cavity. The sleeve, the elastic member and the drive member are mounted within the cavity of the base. The sleeve consists of a polygonal assembly rod and a first stopping flange connected to one end of the assembly rod. The first stopping flange is engaging against and positioned in the bottom of the cavity. The drive member is composed of a first assembly end, a second assembly end opposite to the first assembly end, and a second stopping flange radially arranged around the drive member. A polygonal connection hole is formed on the first assembly end of the drive member for the polygonal assembly rod of the sleeve to fit in. The elastic member is fit around the assembly rod of the sleeve and located between the first stopping flange of the sleeve and the second stopping flange of the drive member while two ends of the elastic member are against the first stopping flange of the sleeve and the second stopping flange of the drive member respectively. Thus the second stopping flange of the drive member is located and positioned in a recessed area between the wall of the cavity and the stopping portion.

The stopping portion formed on the wall of the cavity of the base is a block. The block is a pyramidal frustum, tapered from the bottom to an opening of the cavity and including a shorter end, and a longer end opposite to the shorter end and arranged with an engaging surface. At least one notch is formed on the second stopping flange of the drive member for being connected to the block on the wall of the cavity and a width of the notch of the second stopping flange is between the length of the shorter end and the length of the longer end of the block. Thus the notch of the second stopping flange is moved from the shorter end of the block and passed through the longer end of the block to make the second stopping flange of the drive member engage against the engaging surface on the longer end of the block to be positioned.

A plurality of blocks is spaced unevenly around the wall of the cavity of the base while a plurality of notches is arranged around the second stopping flange of the drive member irregularly. The blocks of the cavity of the base are connected to the notches of the second stopping flange of the drive member correspondingly.

Each of the notches arranged around the second stopping flange of the drive member is tapered from the first assembly end to the second assembly end of the drive member.

A knockout hole radially penetrates through the base and is arranged at the wall of the cavity of the base, adjacent to the longer end of the block.

The second assembly end of the drive member is pyramidal and a plurality of first ribs is evenly spaced around the second assembly end of the drive member.

A piece is disposed on an upper edge of one surface of the base arranged with the cavity.

While being assembled, the sleeve, the elastic member and the drive member are mounted within the cavity of the base in turn and the second stopping flange of the drive member is positioned at a recessed area between the stopping portion and the wall of the cavity of the base owing to the raised-and-recessed structure formed by the wall of the cavity and the stopping portion for preventing the assembled sleeve, the elastic member and the drive member from being released. Thereby the base, the sleeve, the elastic member and the drive member are securely firmly without screws, and also the time and cost for the assembly are reduced. Moreover, the present invention used in the curtain control assembly can prevent children from being strangled in the bead chain owing to the drive member which is able to be rotated and moved axially. The present invention can also be applied to other curtain components that require engagement/disengagement mechanisms, reducing the cost of production.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
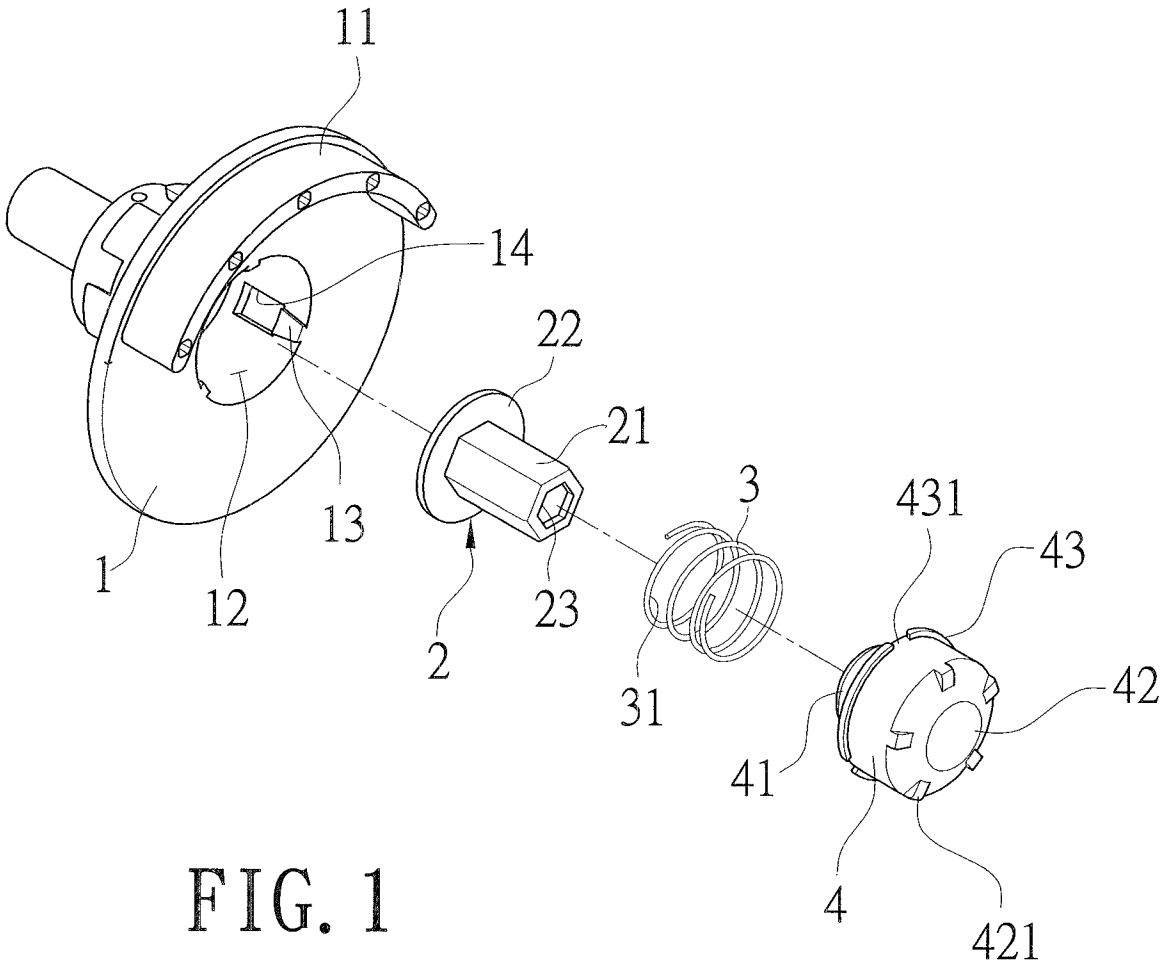
FIG. 1 is an exploded view of an embodiment according to the present invention.
Figure 2:
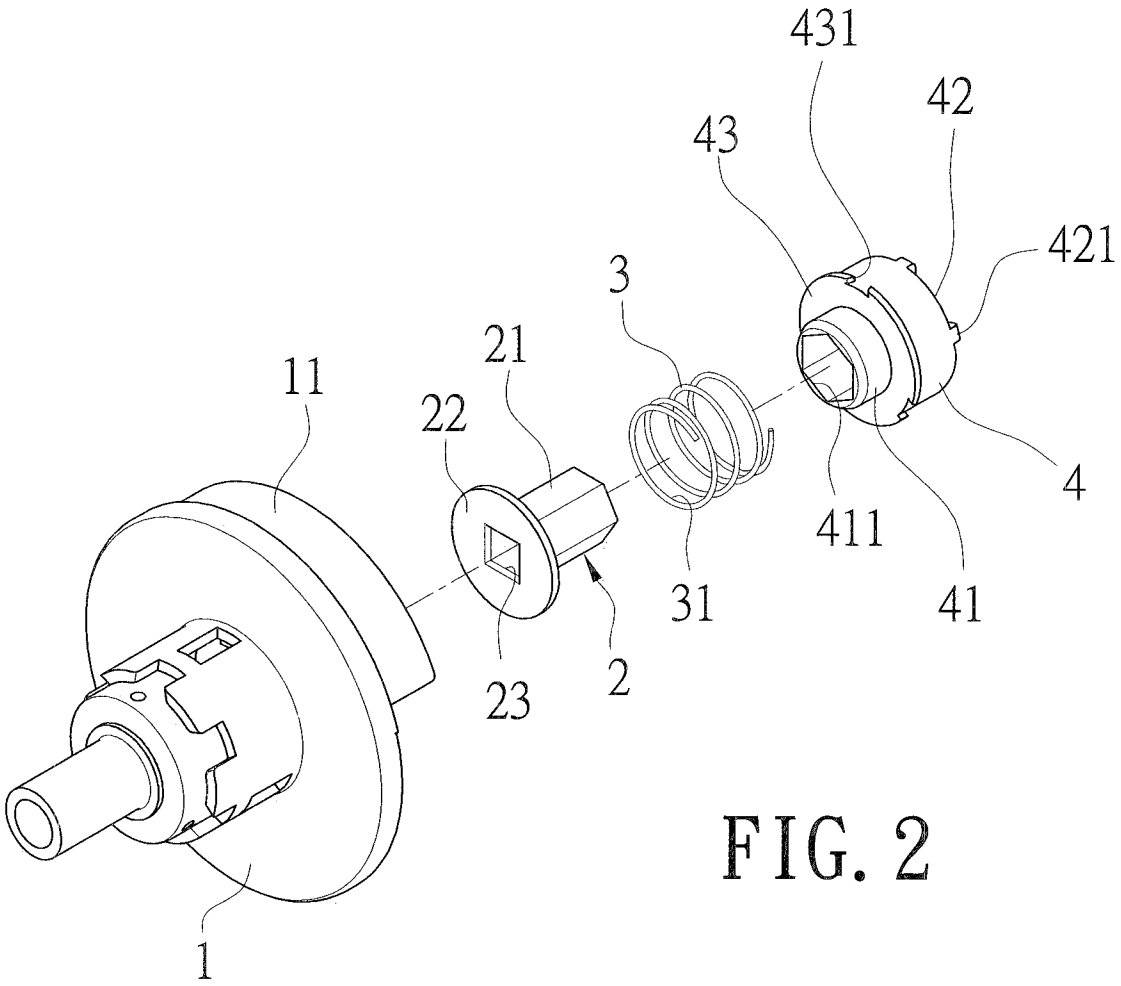
FIG. 2 is another exploded view of an embodiment according to the present invention.

Referring to FIG. 1 and FIG. 2, a safe curtain control assembly without screws according to the present invention mainly includes a base 1, a sleeve 2, an elastic member 3 and a drive member 4.

Figure 3:
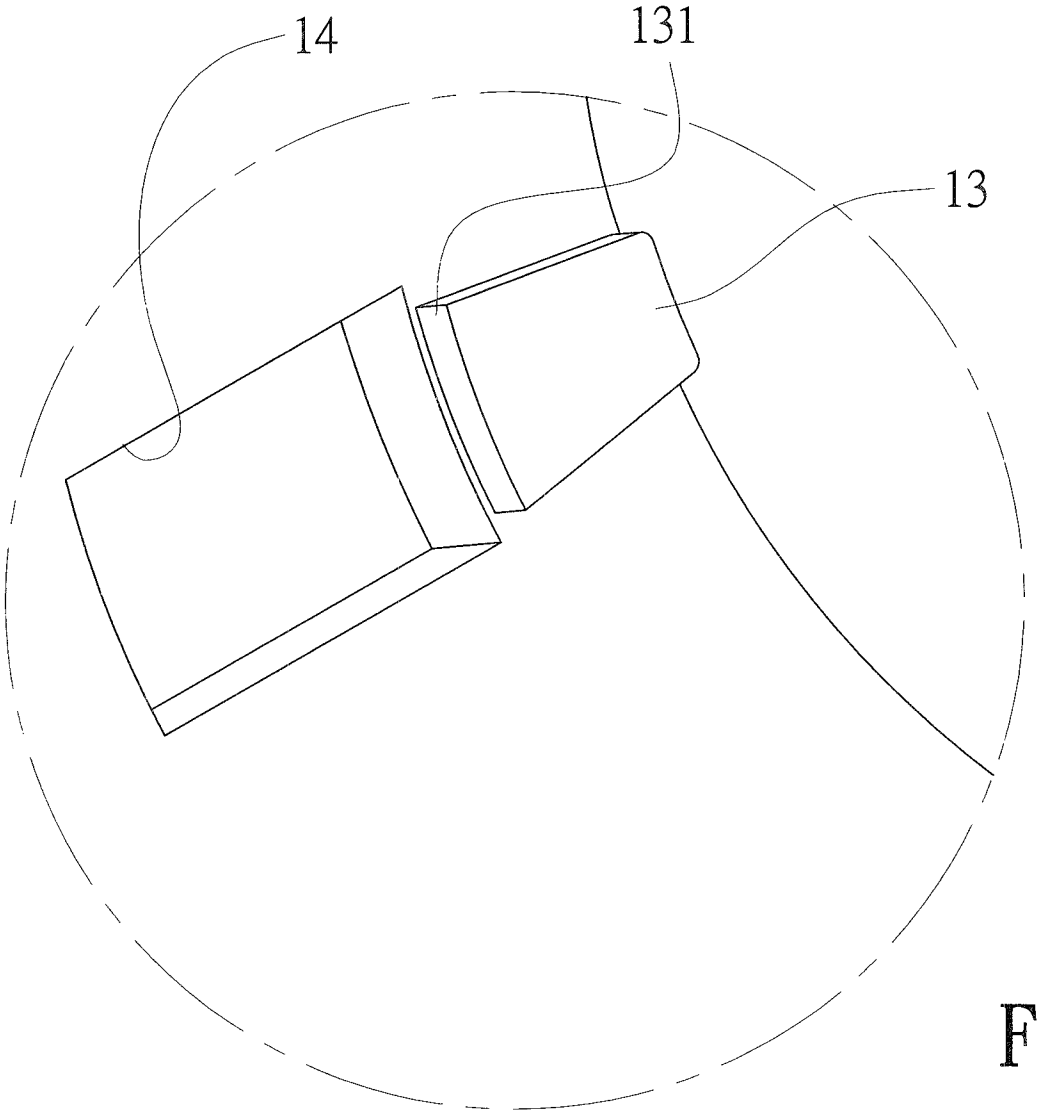
FIG. 3 is a partial enlarged view of an embodiment according to the present invention.

The base 1 consists of a piece 11, a cavity 12, at least one stopping portion that is a block 13, and at least one knockout hole 14. The piece 11 is disposed on an upper edge of one surface of the base 1 and the cavity 12 is formed on a center of the surface of the base 1. The stopping portion (the block 13) is formed on a wall of the cavity 12. A raised-and-recessed structure is formed by the stopping portion (that is, the block 13) and the wall of the cavity 12. Also, with reference to FIG. 3, the block 13 is a pyramidal frustum (such as a square frustum in this embodiment), tapered from the bottom to the opening of the cavity 12 and having a shorter end and a longer end opposite to each other while a engaging surface 131 is formed on the longer end. In a preferred embodiment of the present invention, a plurality of blocks 13 is spaced unevenly around the wall of the cavity 12, with differing angular distances between pairs of adjacent blocks 13. The knockout hole 14 radially penetrates the base 1 and is arranged at the wall of the cavity 12 beside the longer end of the block 13 for releasing of the base 1 after injection molding.

The sleeve 2 is composed of a polygonal assembly rod 21, a first stopping flange 22 formed on one end of the assembly rod 21, and a polygonal hole 23 formed at the center of the assembly rod 21. In this embodiment, the cross section of the assembly rod 21 is hexagonal and the cross section of the hole 23 is rectangular. The sleeve 2 is mounted within the cavity 12 of the base 1 and the first stopping flange 22 is against the bottom of the cavity 12 for positioning.

The elastic member 3 is a compression spring having a through hole 31 at a center thereof for being connected to the assembly rod 21 of the sleeve 2.

Figure 4:
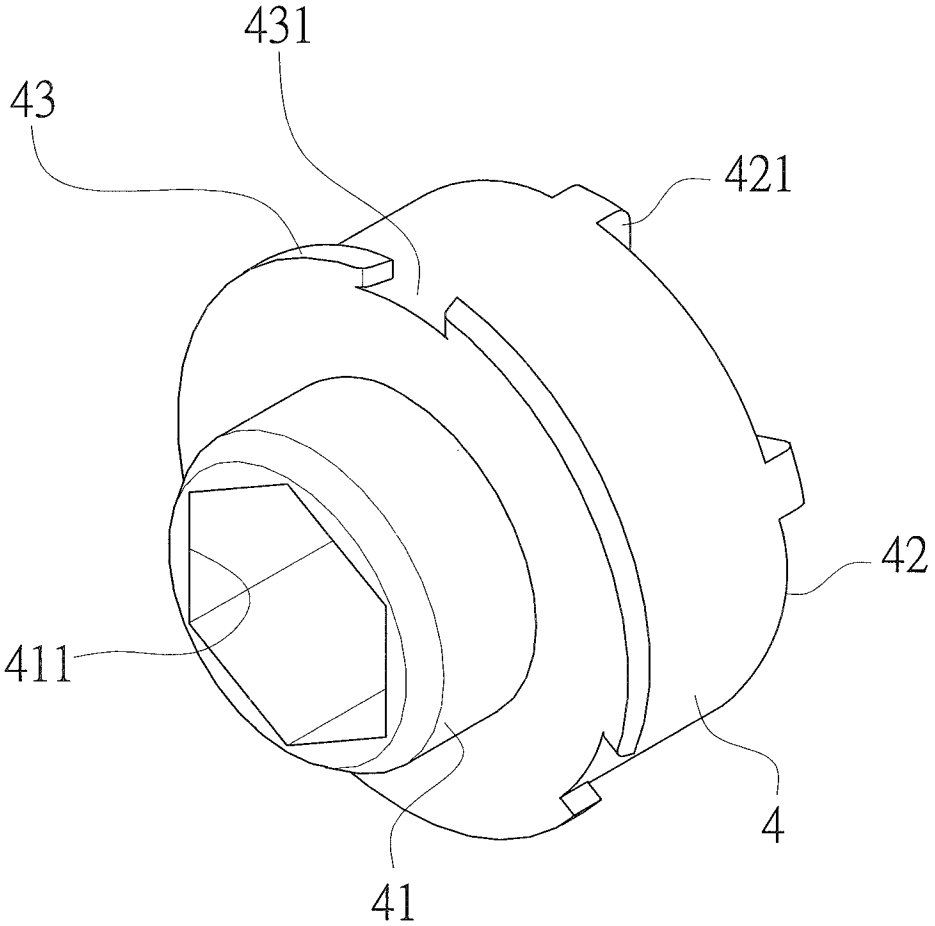
FIG. 4 is a perspective view of a transmission part of an embodiment according to the present invention.
Figure 7:
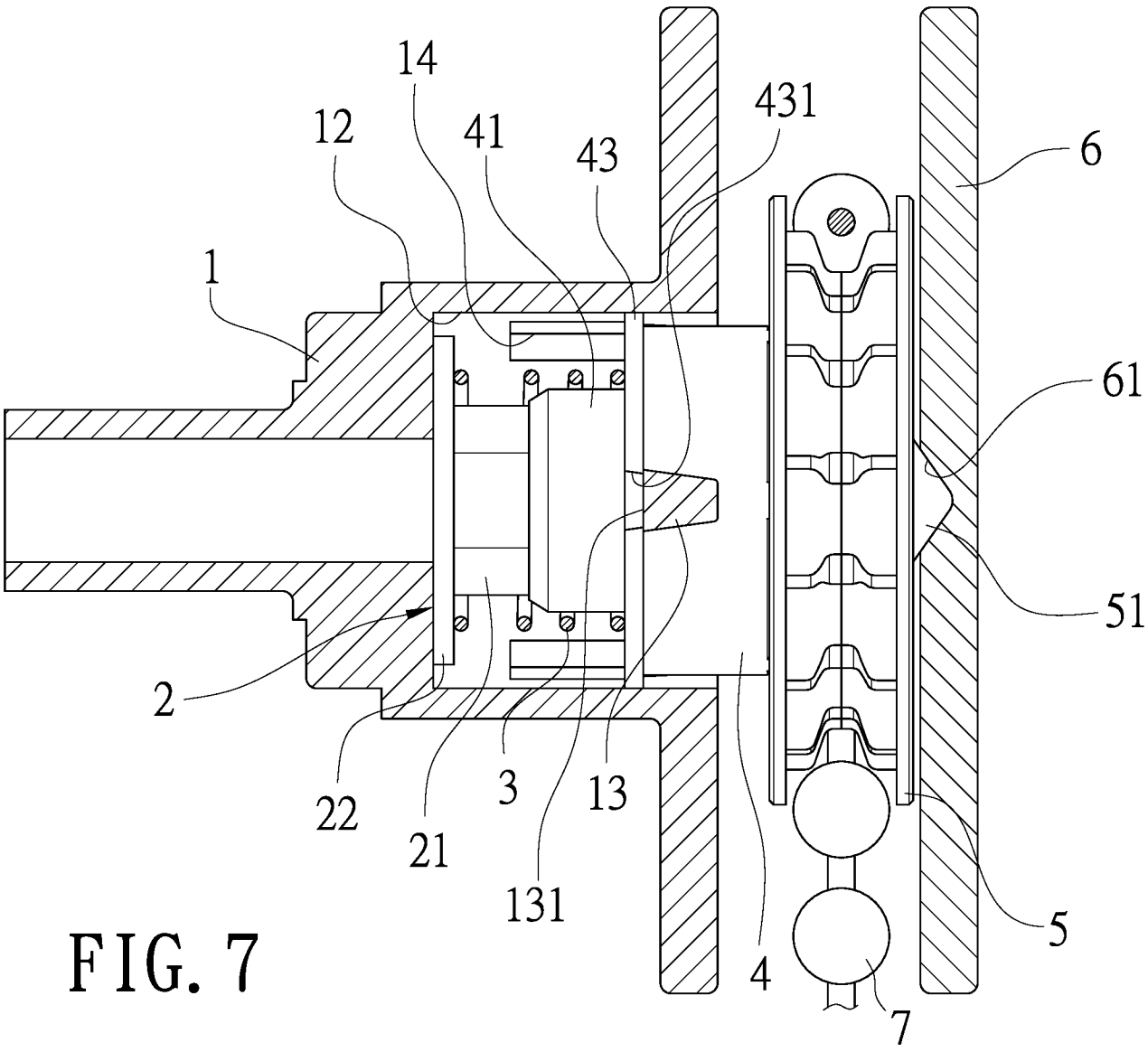
FIG. 7 is a front sectional view of an embodiment according to the present invention.
Figure 8:
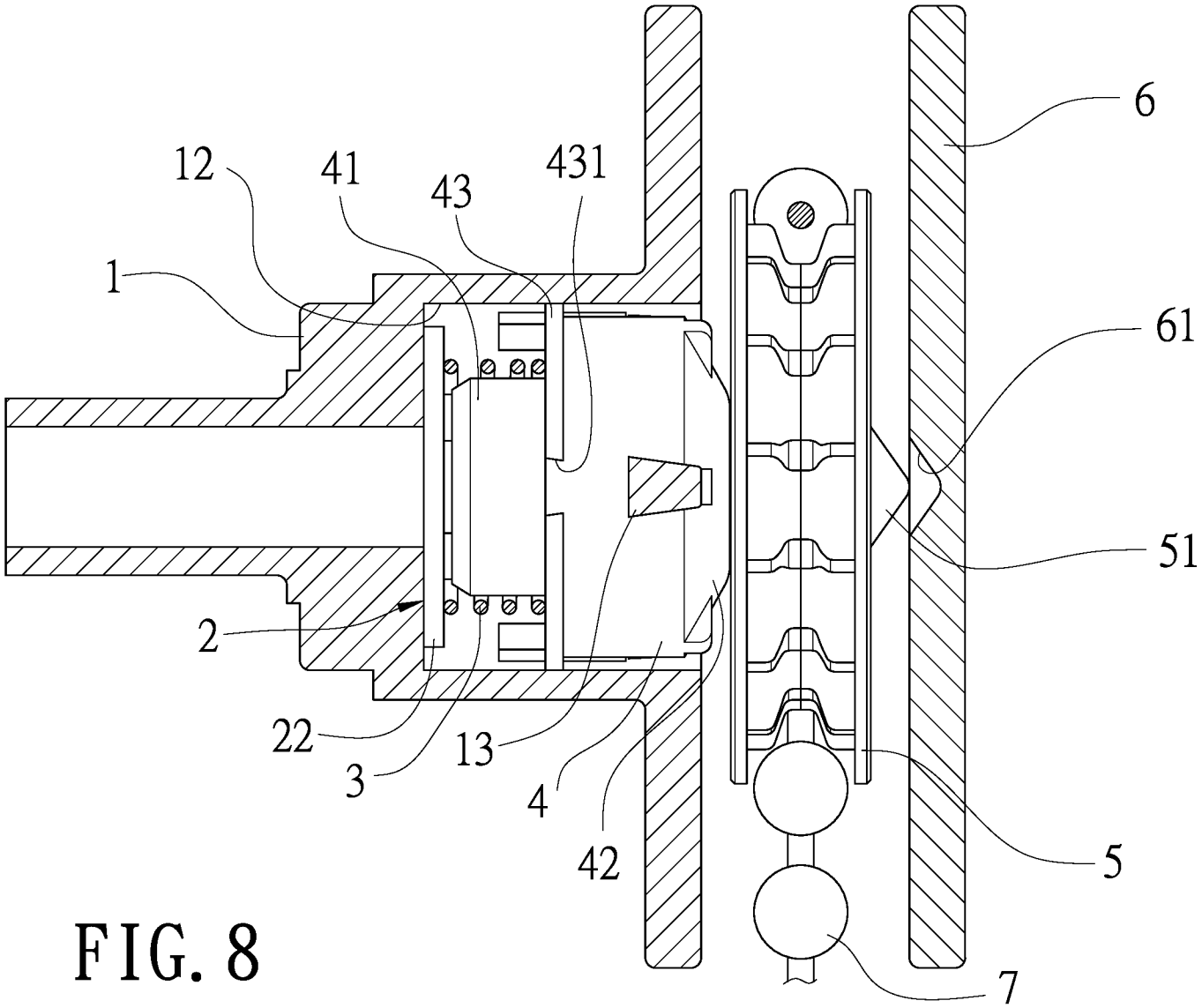
FIG. 8 is a front sectional view showing an embodiment in use according to the present invention.

The drive member 4 includes a first assembly end 41, a second assembly end 42 opposite to the first assembly end 41, and a second stopping flange 43 radially arranged around the drive member. A polygonal (such as hexagonal) connection hole 411 is formed on an end of the first assembly end 41 of the drive member 4 for being fit on the polygonal (such as hexagonal) assembly rod 21 of the sleeve 2. The elastic member 3 is set between the first stopping flange 22 of the sleeve 2 and the second stopping flange 43 of the drive member 4 and having two ends thereof against the first stopping flange 22 of the sleeve 2 and the second stopping flange 43 of the drive member 4 respectively for positioning. At least one notch 431 is formed on the second stopping flange 43 for being connected to the block 13 (as the stopping portion) on the wall of the cavity 12. In a preferred embodiment, a plurality of notches 431 is arranged around the second stopping flange 43 with irregular spacing, with differing angular distances between pairs of adjacent notches 431. The blocks 13 on the wall of the cavity 12 are connected to the notches 431 of the second stopping flange 43 of the drive member 4 and a width of the notch 431 of the second stopping flange 43 is larger than the length of the shorter end but smaller than the length of the longer end of the block 13. Thus the notch 431 of the second stopping flange 43 is moved from the shorter end of the block 13, along the block 13 and passed over the longer end of the block 13 to position the second stopping flange 43 to engage (for example, as illustrated in FIG. 7, to abut) against the engaging surface 131 on the longer end of the block 13. Thereby the second stopping flange 43 is located and positioned in a recess between the wall of the cavity 12 and the stopping portion/the block 13. Referring to FIG. 4, the notch 431 of the second stopping flange 43 is tapered from the first assembly end 41 to the second assembly end 42 so that the notch 431 of the second stopping flange 43 is moved along the block 13 more smoothly. Moreover, the second assembly end 42 of the drive member 4 is a conical frustum and a plurality of first ribs 421 is evenly spaced therearound. The angular distance between each pair of adjacent first ribs 421 is the same.

Figure 5:
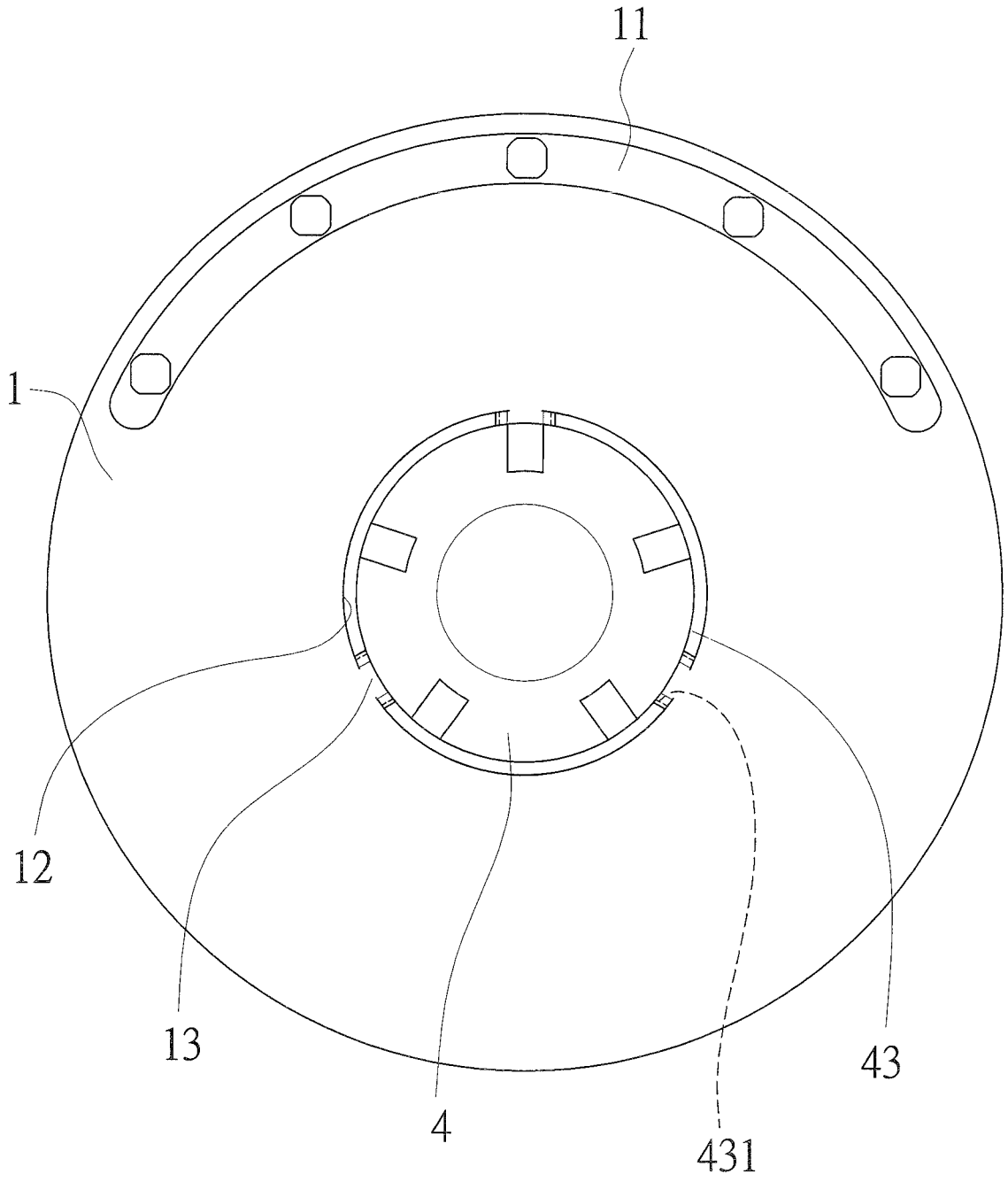
FIG. 5 is a side sectional view of an embodiment according to the present invention.

While being assembled, the assembly rod 21 of the sleeve 2 is passed through the through hole 31 of the elastic member 3 to be inserted into the polygonal hole 411 of the first assembly end 41 of the drive member 4. Thus the elastic member 3 is set between and engaging against the first stopping flange 22 of the sleeve 2 and the second stopping flange 43 of the drive member 4. Then the sleeve 2, the elastic member 3 and the drive member 4 assembled are mounted within the cavity 12 of the base 1 while the notches 431 around the second stopping flange 43 of the drive member 4 are moved from the shorter end of the frustum-shaped blocks 13 on the cavity 12 of the base 1 to the longer end of the frustum-shaped blocks 13 on the cavity 12 of the base 1 under guidance of the tapered design of the notches 431 (as shown in FIG. 4). The notches 431 of the second stopping flange 43 are elastically deformed while being moved over the longer end of the frustum-shaped blocks 13, and then is returned to the original shape after passing the longer end of the frustum-shaped blocks 13. Thus the second stopping flange 43 of the drive member 4 is stopped and positioned by the engaging surface 131 on the longer end of the block 13, as shown in FIG. 5. Therefore the base 1, the sleeve 2, the elastic member 3 and the drive member 4 have been assembled conveniently and rapidly. No screws are required to be fastened one by one, and therefore both the cost of the screws and the time spent on assembly are reduced.

Figure 6:
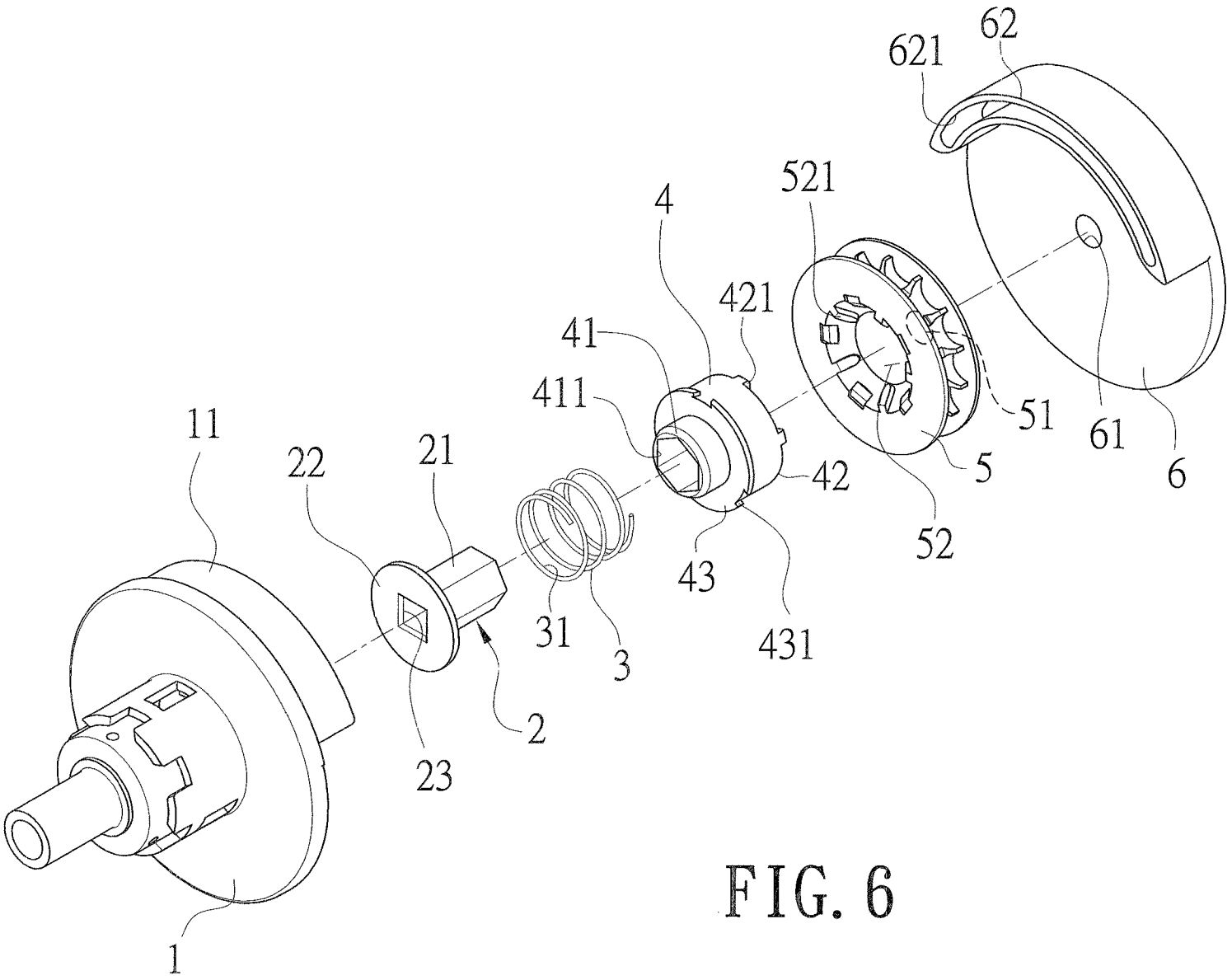
FIG. 6 is an exploded view showing an embodiment being assembled with other curtain parts according to the present invention.

Referring to FIG. 6 and FIG. 7, the assembly of the base 1, the sleeve 2, the elastic member 3 and the drive member 4 is further connected to a bead chain roller 5 and a fixing seat 6. The bead chain roller 5 includes a conical bump 51 on a first surface and a conical hole 52 on a center of a second surface that is opposite to the first surface. A plurality of second ribs 521 is evenly spaced around a wall of the conical hole 52. The angular distance between each pair of adjacent second ribs 521 is the same. The second assembly end 42 of the drive member 4 is mounted within the conical hole 52 of the bead chain roller 5 and the first ribs 421 on the second assembly end 42 are engaging against and positioned by the second ribs 521 the conical hole 52. Then a bead chain 7 is wound around the bead chain roller 5. As to the fixing seat 6, a conical recess 61 is formed on a center of a surface thereof and a connection portion 62 is affixed to an upper edge of the surface thereof while a groove 621 is formed on the connection portion 62. Thus the piece 11 of the base 1 can be inserted into the groove 621 on the connection portion 62 of the fixing seat 6 and then the conical bump 51 on the first surface of the bead chain roller 5 is connected to the conical recess 61 on the surface of the fixing seat 6. Thereby the sleeve 2, the elastic member 3, the drive member 4 and the bead chain roller 5 are assembled between the base 1 and the fixing seat 6. Next one end of a polygonal (such as rectangular) drive shaft is passed through an insertion hole at the center of the base 1 and fit into the polygonal hole 23 of the sleeve 2 for connecting the base 1 and the sleeve 2, while the other end of the drive shaft is connected to a sleeve or a cord winder of a curtain rod.

Thereby users can pull the bead chain 7 for driving the bead chain roller 5 to rotate while in use. Once the bead chain roller 5 is rotated, the second ribs 521 on the wall of the conical hole 52 of the bead chain roller 5 are against the first ribs 421 on the second assembly end 42 of the drive member 4 for driving the drive member 4 to rotate synchronously. Then the sleeve 2 is further driven to rotate when the drive member 4 is rotated, owing to the polygonal assembly rod 21 of the sleeve 2 fitted within the polygonal connection hole 411 on the first assembly end 41. The drive shaft connected to the sleeve 2 is also driven to rotate and further drive the sleeve or the cord winder of the curtain rod on the other end thereof to rotate for closing or opening a curtain.

Furthermore, children will apply a force to the bead chain 7 when they are playing with the bead chain 7 and their neck becomes tangled in the bead chain 7. A ramp on the conical hole 52 of the bead chain roller 5 in contact with the conical second assembly end 42 of the drive member 4 gives the drive member 4 an axial component of the applied force so that the elastic member 3 is compressed by the drive member 4 and the drive member 4 is moved toward the sleeve 2. Thereby the bead chain roller 5 is gradually pulled from the fixing seat 6. The conical bump 51 on the first surface of the bead chain roller 5 is also slipped from the conical recess 61 of the fixing seat 6 when the conical hole 52 on the second surface of the bead chain roller 5 is released from the second assembly end 42 of the drive member 4. Thus the bead chain roller 5 is released from the fixing seat 6 and the drive member 4 while the bead chain 7 and the bead chain roller 5 are separated from each other. This prevents children from getting entangled around the neck or even strangled.

In summary, the present invention has the following advantages:

1. The present safe curtain control assembly without screws includes at least one stopping portion disposed on the wall of the cavity of the base so that a raised-and-recessed structure is formed by the wall of the cavity and the stopping portion. Moreover, the second stopping flange of the drive member is arranged at and positioned in a recess between the wall of the cavity and the stopping portion for preventing the drive member from being released. Thus the components such as the drive member are secured firmly in the cavity of the base without screws. Thereby assembly time required during production is reduced efficiently and the shipping efficiency of curtains is increased.

2. A knockout hole radially penetrates through the base at the wall of the cavity of the base, adjacent to the longer end of the block. Thereby the product of the base with the block can be released smoothly after injection molding due to the knockout hole.

3. The present safe curtain control assembly without screws features a simple structure, easy assembly, and engagement/disengagement functions. Thereby the assembly is not only applied to the curtain control for preventing children from being strangled in the bead chain, but can also be used in various tools with engagement/disengagement means that requires both rotation and axial displacement.

4. The present safe curtain control assembly without screws includes a engaging surface located on the longer end of the pyramidal frustum of the block. Thereby a stopping structure formed by the engaging surface of the block and the second stopping flange of the drive member can prevent the drive member from being released from the cavity of the base while the drive member is rotated or moved axially in the cavity of the base. Moreover, the engaging surface provides positioning function similar to bearing positioning during rotation of the drive member so that the drive member is rotated stably.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A safe curtain control assembly comprising:

a base with a cavity centrally formed on a surface thereof, the cavity defined by at least one wall and a bottom, at least one stopping portion forming a raised structure on the wall of the cavity, the stopping portion including at least one block having a longer end and a shorter end opposite the longer end, an engaging surface being defined by the longer end of the stopping portion, a recess being defined by the wall of the cavity between the engaging surface of the stopping portion and the bottom of the cavity;

a sleeve including a polygonal assembly rod, and a first stopping flange connected to one end of the assembly rod, the first stopping flange engaging against and positioned at the bottom of the cavity;

an elastic member set around the assembly rod of the sleeve;

a drive member including a first assembly end with a polygonal connection hole, a second assembly end opposite to the first assembly end, and a second stopping flange radially arranged around the drive member;

wherein the sleeve, the elastic member, and the drive member are mounted within the cavity of the base in turn;

the assembly rod of the sleeve is inserted in and connected to the polygonal connection hole of the drive member;

the elastic member is disposed between the first stopping flange of the sleeve and the second stopping flange of the drive member, opposing ends of the elastic member engaging the first stopping flange of the sleeve and the second stopping flange of the drive member respectively; and the second stopping flange of the drive member displaceably engages the engaging surface of the block upon assembly, the second stopping flange of the drive member thereby secured in the recess between the bottom of the cavity and the stopping portion, the second stopping flange axially and rotationally displaceable within the cavity, the sleeve and the elastic member secured between the second stopping flange and the bottom of the cavity.

2. The device as claimed in claim 1, wherein:

the block is a pyramidal frustum tapered from the longer end to the shorter end, and at least one notch is formed on the second stopping flange of the drive member, a width of the notch of the second stopping flange being larger than a length of the shorter end of the block and smaller than a length of the longer end of the block, the block on the wall of the cavity being thereby configured to be inserted through the notch of the second stopping flange during assembly, and the notch being configured to be elastically deformed during insertion of the block.

3. The device as claimed in claim 2, wherein a plurality of blocks is spaced around the cavity of the base, and a plurality of notches is arranged around the second stopping flange to correspond to the blocks.

4. The device as claimed in claim 2, wherein the notch on the second stopping flange of the drive member is tapered from the first assembly end to the second assembly end of the drive member.

5. The device as claimed in claim 1, wherein a knockout hole penetrates through the wall of the cavity of the base adjacent to the longer end of the block.

6. The device as claimed in claim 1, wherein the second assembly end of the drive member is conical, and a plurality of first ribs is evenly spaced around the second assembly end of the drive member.

7. The device as claimed in claim 1, wherein a piece is disposed on the surface of the base to surround the cavity.

* * * * *